US008360489B2

(12) United States Patent
Cho

(10) Patent No.: US 8,360,489 B2
(45) Date of Patent: Jan. 29, 2013

(54) CYLINDRICAL LEVER LOCK

(75) Inventor: Chang Soo Cho, Daegu (KR)

(73) Assignee: Junghwa Tech Co., Ltd. (KR)

( * ) Notice: Subject to any disclaimer, the term of this patent is extended or adjusted under 35 U.S.C. 154(b) by 363 days.

(21) Appl. No.: 12/502,119

(22) Filed: Jul. 13, 2009

(65) Prior Publication Data

US 2011/0006550 A1 Jan. 13, 2011

(51) Int. Cl.
*E05B 15/02* (2006.01)
*E05B 3/00* (2006.01)

(52) U.S. Cl. ..... 292/357; 292/336.3; 292/347; 292/348; 292/DIG. 53; 70/224; 70/451

(58) Field of Classification Search ..... 292/347–350, 292/336.3, 352, 353, 355, 357–359, DIG. 53, 292/DIG. 54, DIG. 60, DIG. 64; 70/224, 70/450–452, 461, 466
See application file for complete search history.

(56) References Cited

U.S. PATENT DOCUMENTS

| | | | | | |
|---|---|---|---|---|---|
| 4,869,083 | A | * | 9/1989 | DeMarseilles et al. | 70/224 |
| 4,998,760 | A | * | 3/1991 | Nixon et al. | 292/347 |
| 5,141,269 | A | * | 8/1992 | Haq et al. | 292/169 |
| 5,236,235 | A | * | 8/1993 | Gustafson et al. | 292/357 |
| 5,265,924 | A | * | 11/1993 | Kim | 292/336.3 |
| 5,411,303 | A | * | 5/1995 | To | 292/357 |
| 5,481,890 | A | * | 1/1996 | Millman | 70/224 |
| 5,564,296 | A | * | 10/1996 | Theriault et al. | 70/224 |
| 5,666,833 | A | * | 9/1997 | Gao et al. | 70/224 |
| 5,718,468 | A | * | 2/1998 | Qureshi et al. | 292/347 |
| 5,727,406 | A | * | 3/1998 | Banducci | 70/224 |
| 5,732,578 | A | * | 3/1998 | Kang | 70/224 |
| 5,761,936 | A | * | 6/1998 | Katayama | 70/224 |
| 6,038,894 | A | * | 3/2000 | Hu | 70/224 |
| 6,048,007 | A | * | 4/2000 | Shor | 292/348 |
| 6,880,872 | B2 | * | 4/2005 | Eller et al. | 292/357 |
| 6,979,029 | B2 | * | 12/2005 | Shen | 292/336.3 |
| 7,066,507 | B2 | * | 6/2006 | Don | 292/336.3 |
| 7,137,657 | B2 | * | 11/2006 | Wu et al. | 292/357 |
| 2008/0302836 | A1 | * | 12/2008 | Mathis | 222/521 |

FOREIGN PATENT DOCUMENTS

EP 526409 A1 * 2/1993

* cited by examiner

*Primary Examiner* — Carlos Lugo
*Assistant Examiner* — Alyson M Merlino
(74) *Attorney, Agent, or Firm* — John K. Park; Park Law Firm

(57) ABSTRACT

A cylindrical lever lock using a lever as a handle for convenient use by even the disabled and the old is disclosed. Since plate shafts, spring holders and spring cage covers constituting the cylindrical lever lock are made of general metal plates, the material cost and the prime cost may be reduced. In addition, the spring holders are connected through double engagements with spring cages and the spring cage covers. Therefore, deformation of parts or drooping of levers may be prevented in spite of an excessive force applied. Furthermore, assembling and disassembling of the parts can be quickly and easily performed by achieving adjustment of intervals of the parts according to thickness of a door using a female screw of an outer attachment plate and a male screw of a boy assembly.

4 Claims, 5 Drawing Sheets

CYLINDRICAL LEVER LOCK

BACKGROUND OF THE INVENTION

1. Field of the Invention

The present invention relates to a cylindrical lever lock capable of preventing a lever from drooping or malfunctioning due to deformation of related parts although being repetitively used or applied with a strong wrenching force during opening and closing of a door, and also capable of reducing the manufacturing cost.

2. Description of the Related Art

A door lock is generally used in various public facilities including public or commercial buildings such as schools, government and public offices, hospitals, and hotels, and such a door lock mostly employs a cylindrical lever lock using a thin and long lever as a handle so that even the disabled and the old are able to conveniently use the lever lock. The lever additionally employs a spring to return the lever rotated to open or close the door to its initial position.

Generally, the lever of the cylindrical lever lock is mounted in a horizontal position for convenient use and applied with a strong wrenching force due to leverage when rotated to open and close a door. Here, the strong wrenching force is totally transmitted to component parts of the lever lock, thereby damaging or deforming related parts. Furthermore, in this case, the related parts may be spaced and the lever may be drooped. As a result, not only the appearance but also the function as a locking device may be deteriorated.

Accordingly, the cylindrical lever lock needs to be manufactured to technically overcome all the above problems. Furthermore, an interval adjusting device is also required for compatible use of the cylindrical lever lock in any type of doors.

KR Utility Model No. 170492 suggests a cylinder-type door lock most satisfactorily meeting the above necessities. The cylinder-type door lock is structured in a manner that springs for preventing drooping of levers are elastically connected to inner and outer attachment plates each including a mounting recess and a fixing protrusion through movable plates. In addition, a supporting plate is fixedly connected through a fixing hole and the fixing protrusion, thereby achieving the drooping prevention function. Also, a locking nut formed at the outside and inner and outer interval maintaining plates are provided so that the interval of parts can be adjusted according to thickness of a door.

However, the inner and outer attachment plates of the conventional art are almost impossible to manufacture using general metal plates because those are thick and structurally complicated since having the mounting recess, the fixing protrusion and the fixing hole. Therefore, casting of Zn or Al is required, which will increase the material cost and the process cost, consequently increasing the manufacturing cost.

Also, the inner and outer attachment plates and the movable plate which are essential parts requiring great strength are not sufficiently durable against the wrenching force since being made of non-ferrous metal having low strength. Nevertheless, the supporting plate to prevent separation of the springs is connected with the fixing holes and the fixing protrusions of the inner and outer attachment plates. Therefore, in case that an excessive force is applied in the wrenching direction while the door is being opened or closed by rotation of the lever, the fixing protrusions of the plates may be deformed and accordingly the supporting plate, the movable plates and the springs may be separated from the inner and outer attachment plates. As a result, the lever lock cannot normally operate, thus finishing the lifespan.

Especially, the lever is structured such that a rotation angle thereof is restricted by a stopper protrusion formed at an end of a guiding tube of each of the inner and outer attachment plates. Therefore, if an excessive force is applied through the lever, the guiding tube of the plates made of Zn or Al would be easily deformed. Also, since the movable plate is in the form of a flat panel very susceptible to wrench, a rim of the movable plate may be deformed and spaced, accordingly causing drooping of the lever. Moreover, friction around the deformed part will hinder a favorable operation of the lever.

Furthermore, since the locking nut is prepared in addition to the interval maintaining plates in order to adjust interval among the component parts according to thickness of the door, the processes will take much time and become complicated during pre-assembling for shipment of the product or during disassembling and installation in the field.

SUMMARY OF THE INVENTION

Therefore, the present invention has been made in view of the above problems, and it is an object of the present invention to provide a cylindrical lever lock capable of enduring a strong wrenching force during use, maintaining horizontal position of a lever as well as preventing drooping of the lever even after a longtime use, achieving quicker and easier assembling and installation by reducing the number of parts required for adjustment of part intervals according to thickness of a door, and reducing the manufacturing cost by manufacturing main parts for prevention of the lever drooping using general metal plates.

In accordance with the present invention, the above and other objects can be accomplished by the provision of a cylindrical lever lock structured in a manner that a rotation spring is elastically connected to a plate shaft through a spring cage and a spring holder, wherein the plate shaft is fixedly inserted in a plate as being fixedly connected with a spring cage cover to prevent separation of the rotation spring, thereby maintaining horizontality of the lever, and the spring holder is engaged doubly with the spring cage and with a stopper protrusion of the spring cage cover through fixing pieces formed on the inside and the outside such that a rotation angle of the lever is restricted and the lever is able to endure even a strong wrenching force. Also, the interval adjustment of the parts according to thickness of the door may be achieved using inner and outer attachment plates, a female screw provided to the outer plate and a male screw provided to a body assembly.

BRIEF DESCRIPTION OF THE DRAWINGS

The above and other objects, features of the present invention will be more clearly understood from the following detailed description taken in conjunction with the accompanying drawings, in which.

DETAILED DESCRIPTION OF THE PREFERRED EMBODIMENTS

Figure 1:
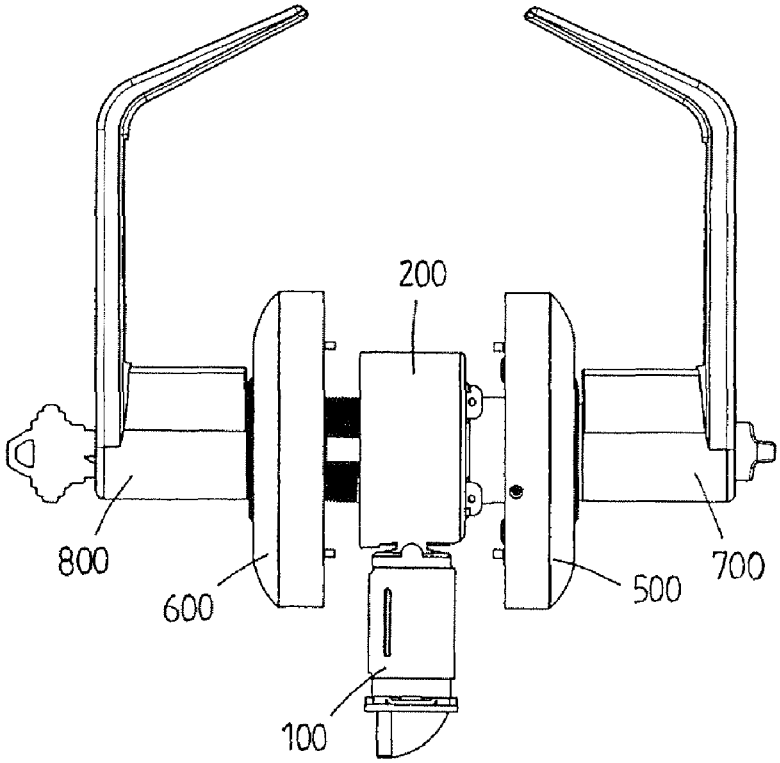
FIG. 1 is a plan view showing the structure of a cylindrical lever lock according to an embodiment of the present invention.

Hereinafter, an exemplary embodiment of the present invention will be described in detail with reference to the accompanying drawings. In the following description, like elements are cited by like reference numerals while generally-known structures and functions will not be explained in detail so as not to obscure the present invention.

Figure 2:
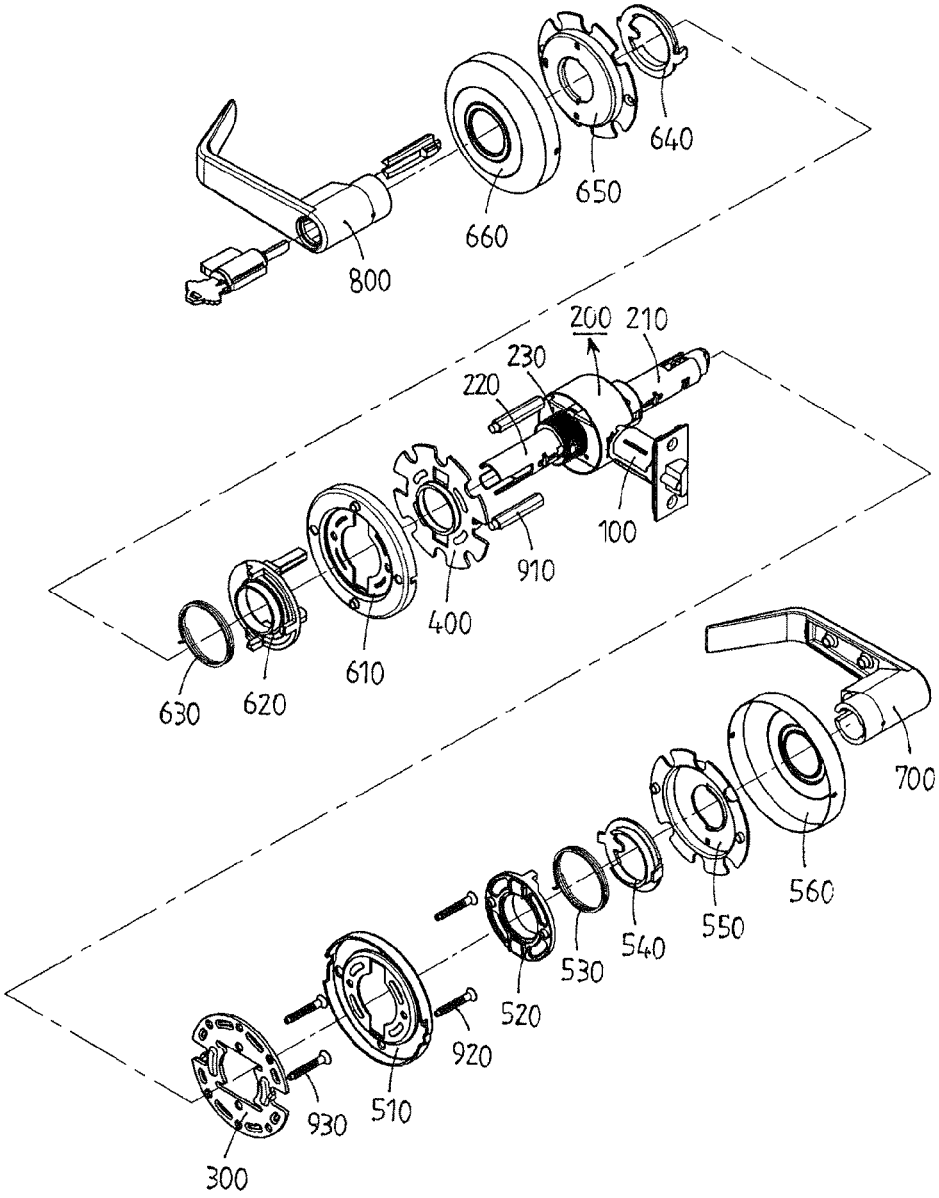
FIG. 2 is an exploded perspective view of the cylindrical lever lock.

FIG. 1 is a plan view showing the structure of a cylindrical lever lock according to an embodiment of the present invention, and FIG. 2 is an exploded perspective view of the cylindrical lever lock. The cylindrical lever lock includes a latch assembly 100 connected to a front of a body assembly 200. Inner and outer attachment plates 300 and 400, inner and outer plate assemblies 500 and 600, and inner and outer levers 700 and 800 are sequentially connected to both sides of the body assembly 200 disposed between each pair of the above parts.

The latch assembly 100, the body assembly 200 and the inner and outer levers 700 and 800 of this embodiment have generally known structures. More particularly, the inner and outer attachment plates 300 and 400, the inner and outer plate assemblies 500 and 600 and the inner and outer levers 700 and 800 are assembled through inner and outer spindles 210 and 220 of the body assembly 200 and a male screw 230 formed on an outside of the body assembly 200.

Figure 3:
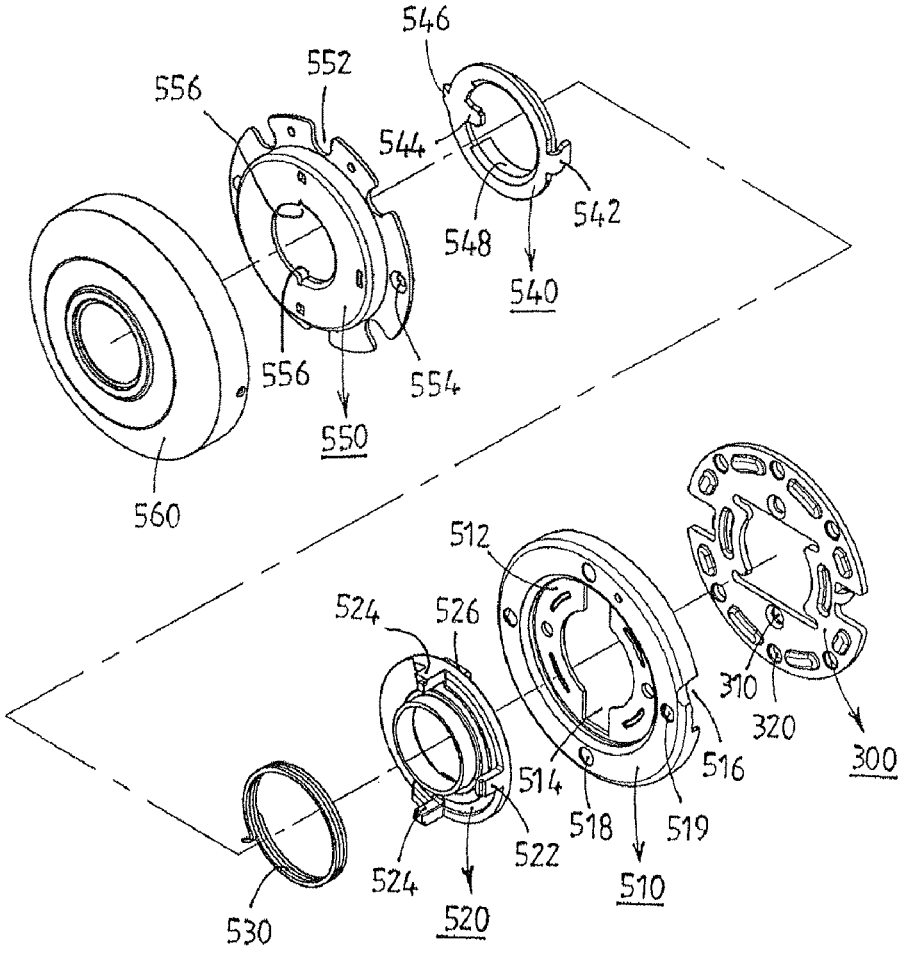
FIG. 3 is an exploded perspective view showing main component parts of the cylindrical lever lock according to the embodiment of the present invention.
Figure 4:
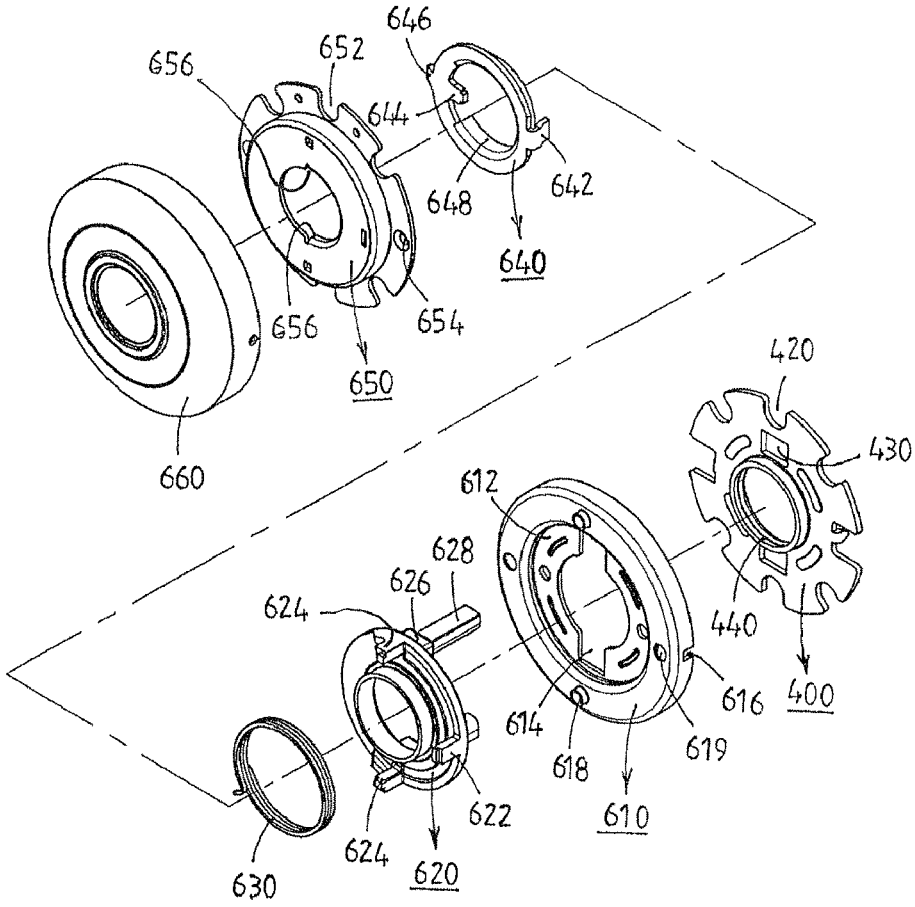
FIG. 4 is an exploded perspective view showing other main component parts of the cylindrical lever lock according to the embodiment of the present invention.
Figure 5:
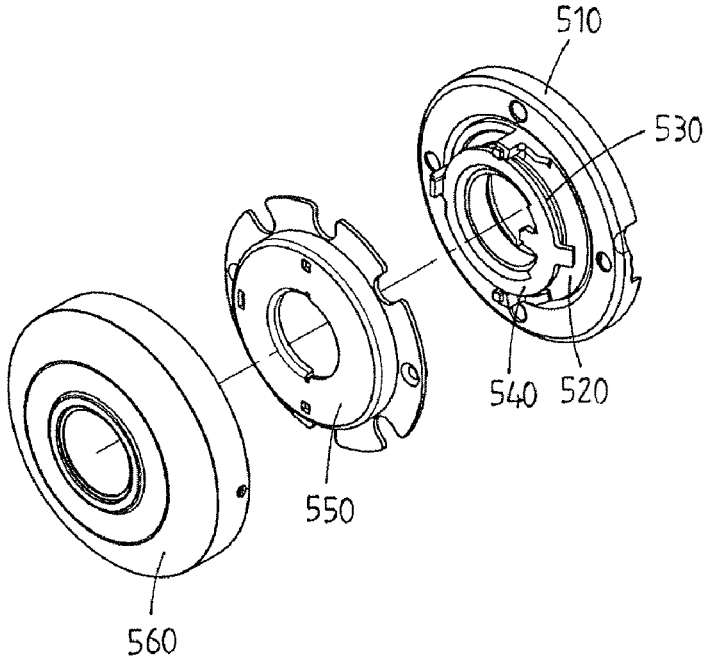
FIG. 5 is a partially-assembled perspective view of an inner plate assembly of the cylindrical lever lock.
Figure 6:
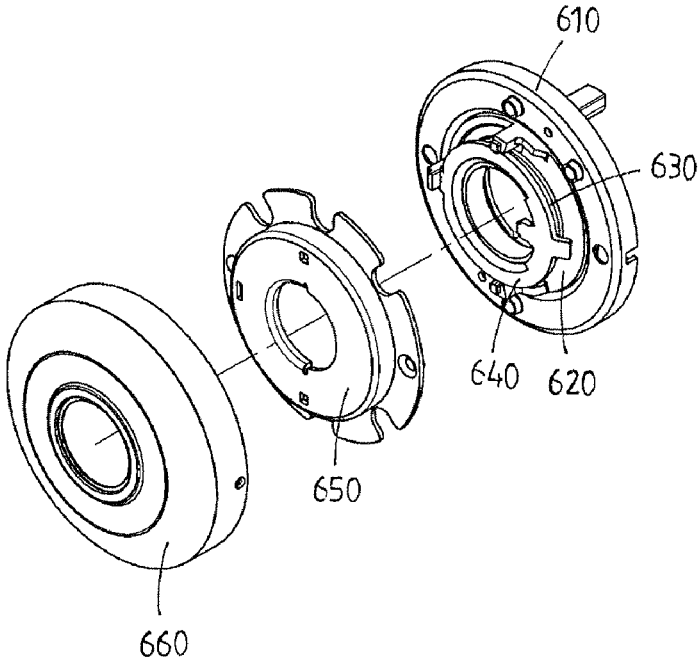
FIG. 6 is a partially-assembled perspective view of an outer plate assembly of the cylindrical lever lock.

FIG. 3 and FIG. 4 are enlarged perspective views showing main parts of the cylindrical lever lock. The inner and outer attachment plates 300 and 400 are provided to securely fix the cylindrical lever lock to a door and adjust intervals among the parts according to thickness of the door. Connection holes 310 and 320 are formed on the inner attachment plate 300 for bolts 920 and 930 (FIG. 2) to penetrate. On the other hand, the outer attachment plate 400 includes guiding recesses 420, rectangular holes 430 and a female screw 440 formed in the center through burring. The female screw 440 is engaged with the male screw 230 formed at the body assembly 200.

The inner and outer plate assemblies 500 and 600 respectively include plate shafts 510 and 610, spring cages 520 and 620, rotation springs 530 and 630, spring holders 540 and 640, spring cage covers 550 and 650, and plates 560 and 660. Most of the inner and outer pairs of parts are correspondingly connected with each other, being molded of metal plates, although some of them have different configurations between the inner and the outer ones.

More specifically, the inner and outer plate shafts 510 and 610 are each formed by pressing a metal plate to have a flanged rim part. Depressions 512 and 612 are formed in the centers of outer surfaces of the inner and outer plate shafts 510 and 610, respectively. Rectangular recesses 514 and 614 are formed at the depressions 512 and 612, being extended from center holes of the depressions 512 and 612. In addition, fixing recesses 516 and 616 are formed on the flanged rim parts. Especially, the inner plate shaft 510 is formed with upper and lower bolt head holes 518 and left and right rivet holes 519, on a peripheral part around the depression 512. The outer plate shaft 610 is formed with upper and lower bolt pipes 618 formed by burring and left and right rivet holes 619. A dedicated fixing shaft 910 having a bolt hole is connected to the upper and lower bolt pipes 618 of the outer plate shaft 610 such that the bolt 920 is fastened through the bolt head hole 518 of the inner plate shaft 510.

The inner and outer spring cages 520 and 620 are connected respectively in the depressions 512 and 612 of the inner and outer plate shafts 510 and 610. The inner and outer spring cages 520 and 620 respectively include one supporting protrusions 522 and 622 formed on outer surfaces thereof, and a pair of stopper protrusions 524 and 624 spaced by a predetermined interval. Additionally, rectangular protrusions 526 and 626 are protruded on upper and lower parts of an inner surface of the inner and outer spring cages 520 and 620, for engagement with the rectangular recesses 514 and 614 of the plate shafts 510 and 610. Bolt shafts 628 are protruded from the rectangular protrusions 626 of the outer spring cage 620. Therefore, the bolt shafts 628 penetrate the rectangular holes 430 formed at the outer attachment plate 400 and the body assembly 200, thereby fastening the bolt 930 through the connection hole 310 of the inner attachment plate 300.

The inner and outer rotation springs 530 and 630 are bent at both ends thereof as in a general rotation spring structure. Being connected to the respective spring cages 520 and 620, the both bent ends of the rotation springs 530 and 630 are elastically engaged with the supporting protrusions 522 and 622 so as to exert an elastic force.

In addition, the inner and outer spring holders 540 and 640 are formed also by pressing a metal plate. Supporting protrusions 542 and 642 are formed at one side of each flanged rim part so that the both bent ends of the rotation springs 530 and 630 are engaged with the supporting protrusions 542 and 642, thereby exerting an elastic force. On the other side of the flanged rim parts, pairs of fixing pieces 544, 644, 546 and 646 are protruded inwardly and outwardly. Furthermore, pipe-like members 548 and 648 are formed by burring to be protruded in the centers of the inner and outer spring holders 540 and 640.

The inner and outer spring cage covers 550 and 650 are formed also by pressing a metal plate. The spring cage covers 550 and 650 respectively have connection recesses 552 and 652 on outer circumferences thereof to avoid interference with the bolt pipes 618 when connected with the outer plate shaft 610. Rivet holes 554 and 654 are additionally formed on the outer circumferences by burring so that inner and outer spring cage covers 550 and 650 are fixedly riveted through the left and right rivet holes 519 and 619 of the plate shafts 510 and 610 and the rivet holes 554 and 654. In addition, pairs of stopper protrusions 556 and 656 are formed on inner walls of center holes of the spring cage covers 550 and 650, being arranged at a predetermined interval in each pair. Therefore, the stopper protrusions 556 and 656 can be engaged with the fixing pieces 544 and 644 of the spring holders 540 and 640 bidirectionally as the levers 700 and 800 are rotated.

The plates 560 and 660 are formed by pressing to each have a flanged rim part and a penetration hole. The flanged rim parts are partially bent and so inserted in the fixing recesses 516 and 616 of the plate shafts 510 and 610 during assembling, such that the plates 560 and 660 and the plate shafts 510 and 610 can be unitedly interconnected.

According to the embodiment, adjustment of an interval among the component parts in accordance with thickness of a door is achieved as the outer attachment plate 400 is connected with the inner attachment plate 300 fixedly attached to the inside of the door and with the male screw 230 of the body assembly 200 through the female screw 440 thereof. That is, the interval adjustment can be achieved in a simple manner. Also, the cylindrical lever lock can be more quickly and easily assembled and disassembled, thereby improving the installation efficiency.

When assembling the lever lock, the rectangular protrusions 526 and 626 of the inner and outer spring cages 520 and 620 are connected with the rectangular recesses 514 and 614 formed at the depressions 512 and 612 of the plate shafts 510 and 610, thereby achieving multiple surface contacts. In this state, the bolts 930 are fastened to the bolt tubes 628 of the outer spring cage 620 through the connection holes 310 of the inner attachment plate 300. In addition, the bolts 920 are fastened to the fixing shafts 910 formed at the outer plate shaft 610 through the upper and lower bolt head holes 518, thereby achieving secure assembling and fixing of the parts.

The structure of the inner and outer plate assemblies 500 and 600 for preventing drooping of the levers 700 and 800 will now be explained. Since the main parts such as the plate shafts 510 and 610, the spring holders 540 and 640 and the spring cage covers 550 and 650 are made of a metal plate, the material cost may be reduced. In addition, after the rotation springs 530 and 630 are elastically mounted to the plate shafts 510 and 610 using the spring cages 520 and 620 and the spring holders 540 and 640, the spring cage covers 550 and 650 are then fixed by rivets through the rivet holes 554 and 654 and inserted in the plates 560 and 660. Next, the flanged rim parts of the plates 560 and 660 are partially bent. By this, the parts can be securely assembled and smoothly operated.

When the above-structured cylindrical lever lock is applied to a door and a user opens and closes the door using the levers 700 and 800, an excessive wrenching force may be applied through the spring holders 540 and 640 in connection with the levers 700 and 800. Nevertheless, the parts may not be easily deformed since being made of metal plates. Especially, the spring holders 540 and 640 rotated along with the levers 700 and 800 are doubly engaged, that is, with the spring cages 520 and 620 through the inner and outer fixing pieces 544, 644, 546 and 646 and with the stopper protrusions 524, 624, 556 and 656 of the spring cage covers 550 and 650. Therefore, the levers 700 and 800 are not rotated beyond a predetermined angle range, thereby supporting the wrenching force against the wrenching direction. Consequently, deformation and damage of the parts may be restrained.

As apparent from the above description, the present invention provides a cylindrical lever lock wherein main parts of inner and outer plate assemblies for preventing drooping of levers and controlling a rotation angle of the levers are made of metal plates, thereby reducing the manufacturing cost including the material cost. Since strength of the structure is enhanced, the cylindrical lever lock may be able to sufficiently endure even a strong wrenching force, accordingly improving the price and quality competitiveness.

The rotation angle of the lever is controlled by double engagement of fixing pieces formed at spring holders with spring cages and further with stopper protrusions of spring cage covers, respectively. Therefore, although rather excessive force is applied in the rotating direction of the levers, related parts are not deformed or damaged, thereby guaranteeing a predetermined life of use and improving reliability of the product.

Furthermore, the interval adjusting structure can be simplified since the adjustment of intervals among the parts according to thickness of a door is achieved by inner and outer plates, a female screw of the outer plate, and a male screw of a body assembly. Consequently, installation of the cylindrical lever lock can be performed more quickly and easily.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cylindrical lever lock including a body assembly connected with a latch assembly at a front thereof, and pairs of attachment plates, plate assemblies and levers sequentially connected to inner and outer sides of the body assembly, respectively, wherein the inner and outer plate assemblies each comprise:

a plate shaft molded of a metal plate;

a spring cage fixedly connected to the plate shaft to receive a rotation spring;

a spring holder molded of a metal plate and enabling the rotation spring to be elastically connected between the spring cage and the spring holder;

a cover plate fixedly connected to the plate shaft, thereby fixedly inserting a spring cage cover between the cover plate and the spring holder for preventing separation of the rotation spring from between the spring holder and the spring cage;

pairs of stopper protrusions, one pair of which are formed at a predetermined interval on an outer surface of the spring cage and the other pair are formed at another predetermined interval on an inner wall of a center hole of the spring cage cover; and fixing pieces protruding from inner and outer sides of a flanged rim part of the spring holder; and a first supporting protrusion formed at the flanged rim part of the spring holder so that a first bent end of the rotation spring is engaged with the first supporting protrusion and a second supporting protrusion formed on the outer surface of the spring cage so that a second bent end of the rotation spring is engaged with the second supporting protrusion so as to exert an elastic force on the levers, wherein the spring holder is disposed between and engages with the spring cage and the spring cage cover such that the spring holder is rotatable with the levers causing the fixing pieces to engage with the pairs of stopper protrusions as the levers are rotated, such that the levers are not rotated beyond a predetermined angle range.

2. The cylindrical lever lock according to claim 1, wherein the plate shafts each comprise:

a depression formed in the center of an outer surface thereof to receive the spring cage; and at least one rectangular recess extended vertically from a center hole of the depression.

3. The cylindrical lever lock according to claim 2, wherein the plate shafts each have rivet holes on the left and the right with respect to the at least one rectangular recess wherein the spring cage covers each have rivet holes formed by burring on the left and the right with respect to the center hole thereof, so that the plate shafts and the spring cage covers are unitedly connected through the rivet holes.

4. The cylindrical lever lock according to claim 1, wherein the spring holders each have a pipe member extended by burring from an inner circumference thereof excluding a part corresponding to the fixing piece protruding from the inner side of the flanged rim part of the spring holder.

* * * * *